US009969155B2

(12) United States Patent
Duss et al.

(10) Patent No.: US 9,969,155 B2
(45) Date of Patent: May 15, 2018

(54) PRINT SHEET BRAKE

(71) Applicant: Mueller Martini Holding AG, Hergiswil (CH)

(72) Inventors: Hanspeter Duss, Buchs (CH); Daniel Suter, Wittnau (CH); Christian Troxler, Rain (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days. days.

(21) Appl. No.: 14/872,960

(22) Filed: Oct. 1, 2015

(65) Prior Publication Data

US 2016/0096358 A1 Apr. 7, 2016

(30) Foreign Application Priority Data

Oct. 1, 2014 (CH) ..... 01500/14

(51) Int. Cl.

| | |
|---|---|
| ***B41F 21/00*** | (2006.01) |
| ***B65H 9/14*** | (2006.01) |
| ***B65H 29/68*** | (2006.01) |
| ***B65H 45/18*** | (2006.01) |
| ***B65H 45/22*** | (2006.01) |

(52) U.S. Cl.

CPC ..... *B41F 21/00* (2013.01); *B65H 9/14* (2013.01); *B65H 29/686* (2013.01); *B65H 45/18* (2013.01); *B65H 45/22* (2013.01); *B65H 2301/4492* (2013.01)

(58) Field of Classification Search

CPC ..... B65H 2301/164; B65H 2301/17; B65H 2301/45; B65H 2301/452; B65H 2301/4521; B65H 2404/72; B65H 2407/30; B65H 9/14; B65H 2301/4492; B65H 29/686; B65H 45/18; B65H 45/22; B41F 21/00

See application file for complete search history.

(56) References Cited

U.S. PATENT DOCUMENTS

| | | | | |
|---|---|---|---|---|
| 4,289,494 A * | 9/1981 | Bolza-Schunemann | B41F 13/56 198/457.07 |
| 5,718,176 A * | 2/1998 | Stephan | B65H 29/686 101/232 |
| 2002/0140151 A1* | 10/2002 | Couturier | B65H 23/245 270/58.07 |

(Continued)

*Primary Examiner* — David Banh

(74) *Attorney, Agent, or Firm* — FisherBroyles, LLP; Robert Kinberg

(57) ABSTRACT

A device for braking and positioning a print sheet in a processing machine, wherein, along a feeding direction for the print sheet, at least one mechanism exerts a braking force onto the print sheet, to position the print sheet in connection with an operation of a downstream-arranged processing station. The device includes at least a first mechanism operative to release pneumatic, braking-force triggering pulses that act upon the print sheet. At least a second mechanism is operative to generate at last one frictional force that acts upon the print sheet, wherein with aid of at least one of the first mechanism and the second mechanism, intermittent, uniform or oscillating braking forces are generated that act upon the print sheet. A control unit controls the braking forces based on at least one of changeable control profiles resulting from queried operating parameters and stored control profiles.

8 Claims, 2 Drawing Sheets

(56) References Cited

U.S. PATENT DOCUMENTS

| | | | | |
|---|---|---|---|---|
| 2004/0089997 | A1* | 5/2004 | Klein | B65H 29/686<br>271/182 |
| 2004/0124579 | A1* | 7/2004 | Schafer | B65H 29/686<br>271/182 |
| 2006/0244204 | A1* | 11/2006 | Bottger | B65H 29/686<br>271/183 |
| 2007/0001385 | A1* | 1/2007 | Muller | B65H 29/245<br>271/182 |
| 2008/0088081 | A1* | 4/2008 | Miwa | B65H 31/38<br>271/210 |
| 2009/0230618 | A1* | 9/2009 | Holzschneider | B65H 29/02<br>271/270 |
| 2014/0026772 | A1* | 1/2014 | Wolf | B41F 21/00<br>101/407.1 |
| 2015/0102554 | A1* | 4/2015 | Ansermot | B65H 5/222<br>271/265.01 |

* cited by examiner

PRINT SHEET BRAKE

CROSS-REFERENCE TO RELATED APPLICATIONS

Priority is claimed with respect to Swiss Patent Application No. 01500/14, filed Oct. 1, 2014, the disclosure of which is incorporated herein by reference in its entirety.

BACKGROUND OF THE INVENTION

Technical Field

The present application relates to a device and a method for the braking and positioning of a print sheet in a processing machine, using at least one braking-force generating means.

This braking and positioning of the print sheet is available for a basic operation, preferably in connection with the production of folded print sheets in a folding apparatus, wherein the folding apparatus is typically provided with a cross folding and/or a longitudinal folding device.

The print sheets are typically processed starting with a paper roll which is first printed on in a printing press (digital or offset) and is then guided inline into the folding apparatus, wherein the braking and the positioning of the print sheets initially creates the prerequisites for maintaining a uniform and high quality folding operation throughout the production, even at high clock speeds.

With the print sheet being securely positioned upstream of the folding operation, previously printed paper rolls can also be used. Loose sheets can furthermore be supplied individually to the folding apparatus, wherein it must be ensured in this case as well that the sheets are securely positioned before reaching the folding device.

Prior Art

The folding of different substrates (papers), in particular the longitudinal folding, is especially challenging from a technical view since the print sheets coming from the feed device are redirected by 90° with the aid of a sword and must be supplied to a so-called pair of folding rollers. Before the sheet sections are supplied with the aid of a sword or other folding device to the folding roller pair, the sheet section which typically arrives from a cross folding device, must be decelerated within a very short time (a few milliseconds or fractions of milliseconds) from the feeding speed to 0. With the presently known longitudinal folding devices, this is achieved either with an end stop for the print sheet, or a combination of print sheet end stop and brush.

The purpose of the brush is to stop and smooth the incoming sheet sections within the brush width. The sheet sections mostly arrive in the longitudinal folding device with the folding edge (cross fold) in the lead. However, non-folded (meaning without cross fold) sections can also be supplied to the longitudinal folding device.

The longitudinal folding process is basically prior art. The main problem with the sheet redirection or deflection into the folding rollers primarily relates to the stopping of the print sheets at the so-called print sheet end stop. For this, the complete delaying energy is generated abruptly once the print sheet hits the end stop, thus causing the individual sheet to be compressed in the region of the sheet end stop or, in the case of rigid sheets, a portion of the energy is converted to a bouncing back.

The compressing of the print sheets can result in damage to the folding edge and thus result in deficient products, depending on the speed and the type of paper. When the sheets bounce back, they can furthermore rotate slightly, relative to the optimum geometric position, resulting in slanted or parallel folds during the following instant of inserting the sword. To reduce or eliminate these negative effects, numerous measures have already been proposed which are part of the prior art.

The braking brush or brushes are located, for example, in front of the sheet stop and must be adjusted respectively to the product thickness. The disadvantage of this solution is that the braking brushes are subject to strong mechanical wear and the thickness adjustment to the paper is generally very involved. The feeding upper belts furthermore can only be guided to the end of the print sheet section. A bouncing back is thus prevented or the product is returned to the end stop. However, damage to the sheet at the end stop is not prevented in this way. Also conceivable is a combination with other solutions. Further known systems are actively controlled braking devices which stop the print sheet at the end, such that the sheet is only aligned at the end stop.

A system for stopping paper sheets is known from the German patent document DE 199 21 169 C2. With this system, the products are advantageously slowed and stopped from the back, so that they can be stretched and fit flush on the base, e.g. a folding table. The systems have a compact and easy design with few components and is easy to control. According to the description, the system can be used as a sheet brake on folding tables, as a brake for slowing-down stations or in front of the paddles of paddle wheels, so that the products can be processed further without damage. By means of a support, paper sheets are conveyed on transport belts, for example to a folding table for printing presses. These paper sheets can be products cut from paper webs in cross cutters, can be non-folded or single-folded or multiple folded and can be gathered or non-gathered products. A carrier is attached to a frame extending above the paper movement direction. At the end facing away from the frame, an electromagnet is arranged on the carrier. An armature moves inside its coil body, preferably perpendicular to the movement direction and surface of the paper sheets. At the end directed toward the movement track, the armature is provided with a brake shoe with attached brake lining. The brake shoe moves with spring action with the aid of a spring element, e.g. a leaf spring of resilient steel or plastic, and is connected to the carrier through a receptacle. Also conceivable would be a screw spring which is directly accommodated by the armature and supports itself on the housing for the electromagnet as well as an indentation of the armature. By electrically triggering the electromagnet, a magnetic flux field is generated, the force effect of which causes the armature to press the paper sheet via the brake shoe with the lining against another brake lining that is fixedly attached to the support.

German patent document DE 43 07 383 A1 discloses a system for stopping sheets, in particular paper sheets. The sheets are successively transported to a braking device by a fast-moving series of belts, consisting of several spaced-apart, parallel-arranged lower belts and upper belts. While the discharge-side deflection rollers of the lower belts are positioned in front of the braking system, the upper belts extend further into the region of the braking system. The braking system consists of a guide metal, arranged below the intake plane, which extends past the working width. Arranged at the track discharge end of the sheet metal is a slot nozzle through which compressed air is blown counter to the sheet movement across the top of the guide sheet and is directed upward by the sheet end that is curved upward. The air flow generates a low pressure which pulls the back edge of the sheets downward and simultaneously slows down the sheets. The air nozzle is followed directly by a circulating overlap blanket which extends over the width of the machine and moves at the slower depositing speed. The sheets deflected downward by the airflow from the nozzle detach from the upper belts and are deposited on the blanket. In the process, the front edge of the following, not yet slowed down sheet slides over its back edge and an overlapping flow is created which is then transported further at a slower speed.

SUMMARY OF THE INVENTION

It is an object of the invention to reliably and completely stop print sheets moving at high speed within a short period of time in a precise position, using a method and apparatus of the aforementioned type, before these print sheets are subjected to further processing as intended.

According to one embodiment of the invention there is provided a device for braking and positioning a print sheet in a processing machine, wherein, along a feeding direction for the print sheet, at least one mechanism exerts a braking force onto the print sheet, to position the print sheet in connection with an operation of a downstream-arranged processing station, the device comprising: at least a first mechanism operative to release pneumatic, braking-force triggering pulses that act upon the print sheet; at least a second mechanism operative to generate at last one frictional force that acts upon the print sheet, wherein with aid of at least one of the first mechanism and the second mechanism, intermittent, uniform or oscillating braking forces are generated that act upon the print sheet; and a control unit that controls the braking forces based on at least one of changeable control profiles resulting from queried operating parameters and stored control profiles.

According to a further embodiment of the invention, there is provided a combination comprising the above described device for braking and positioning a print sheet in a processing machine and the aforementioned downstream-arranged processing station, wherein the downstream-arranged processing station comprises at least one longitudinal folding device and/or cross folding device.

According to another embodiment of the invention there is provided a method for operating a device for braking and positioning a print sheet in a processing machine, wherein along the feeding direction for the print sheet at least one mechanism exerts a braking force onto the print sheet causing a positioning of the print sheet in connection with the operation of a downstream-arranged processing station, the method comprising: generating, with at least one first mechanism, pneumatic, braking-force triggering pulses to act upon the print sheet; generating, with at least a second mechanism, a braking-force triggering frictional force to act upon the print sheet; acting upon the print sheet with intermittent, uniform or oscillating braking forces generated with the first and second mechanisms; and controlling the braking forces generated by the first and second mechanisms by a control unit which is operated with changeable control profiles based on at least one of queried operating parameters and on stored control profiles.

According to yet another embodiment of the invention there is provided a method for operating a device for the braking and positioning of a print sheet in a processing machine, wherein along the feeding direction for the print sheet at least one mechanism exerts a braking force onto the print sheet to position the print sheet in connection with operation of a downstream-arranged processing station, the method comprising: positioning to a standstill at a precise point for the print sheet by at least one of braking-force triggering pulses and an additional mechanism that introduces a braking force by at least one of generating a vacuum acting upon the print sheet and the use of at least one mechanical element.

In most cases, this precisely positioned stopping is tightly connected to a further processing of the print sheets, for which the precise positioning is a precondition to achieve the desired quality.

However, there are also cases where the braking at a precise position of the print sheets only represents an intermediate step which need not be directly or absolutely connected to the operation of a further processing operation.

Regardless of which final purpose is served with this precisely positioned stopping, the invention is based on the goal of preventing damage to the print sheets, as well as to maintain a precise positioning of the sheets over the complete production process.

Starting with a preferably driven further processing, the print sheets are supplied to a folding device, following the precisely positioned stopping, wherein such a further processing should not be understood to be exclusively and absolutely required, as previously mentioned.

The invention is intended to propose a qualitative and economic modification of the prior art, referring to a device and a method with the goal of achieving a precisely positioned stopping of the print sheet.

Pneumatic means are preferably used for this stopping operation, which inject braking-force triggering air pulses and for which the resulting braking force in a broader sense acts directly and/or indirectly onto the print sheet.

With the direct application, the braking-force triggering air pulses are focused directly onto the print sheet where the effect is implemented, wherein the number, strength and effective location of these air pulses are adapted to the present conditions.

With the indirect transformation, the braking-force triggering air pulses act upon at least one mechanical element, arranged in-between the print sheet and the ejection source for the air pulses, such that the effective braking effect on the print sheet occurs through the aforementioned element, wherein such an element can have varied dynamic configurations.

In addition, the precisely positioned stopping of the print sheet in the feeding direction can at least partially be achieved with a vacuum acting upon the print sheet, which is generated with suitable means within the table-type support, arranged for the most part below the transport belts. As a result, the friction between the surface of the table-type supports and the underside of the print sheet is increased such that this frictional force can advantageously also be used for the precise adjustment for an exact final positioning of the print sheet. As previously mentioned in connection with the air pulses, the number, strength and effective location thereof for generating the vacuum can be adapted to the given conditions.

The two braking forces, meaning the braking-force triggering pulses acting either directly or indirectly upon the print sheet, as well as the increase in friction caused by the vacuum can be controlled interdependent, relative to each other, or independent of each other, wherein the braking force share of the two can be changed from case to case and/or adapted.

Of course, at least one mechanically activated element can also be used to provide an additional braking force which can be used for the precise adjustment in addition to the pneumatic braking-force triggering pulses that act upon the print sheet. A mechanical element of this type can be controlled without problem through an autonomous control, or solely with the aid of air pulses within the above meaning.

The aforementioned braking-force triggering means acting upon the print sheet make it possible to achieve a continuous optimization of the effective braking forces and frictional forces in that a controlled mode of operation is used for which the aforementioned means are operated either interdependently or separately.

This type of operation, which calls for the integration of the direct and/or indirect braking force, as well as the braking by triggering additional frictional effects on the print sheet, is particularly advantageous if the print sheets are to be supplied before or after the folding operation to an overlapping flow or to achieve a corresponding removal from or separating out of the overlapping flow.

Thus, according to the invention several options can be provided for the precisely positioned stopping alone, within the meaning of a standstill at a precise point for the print sheet in feeding direction:

1. The precisely positioned stopping within the meaning of a standstill at a precise point for the print sheet is effected solely with the aid of braking-force triggering pulses and/or the introduction of additional braking forces. With the latter means, this can be achieved by generating a vacuum acting upon the print sheet and/or by using at least one mechanical element.
2. The precisely positioned stopping within the meaning of a standstill at a precise point for the print sheet can be effected solely with the aid of braking-force triggering pulses and/or by introducing additional braking forces, as described in the above No. 1, wherein these measures ensure that the print sheet feeding speed is slowed down relative to the specified end position, enough so that the speed is approximately zero or tends towards zero. The final standstill of the print sheet at a precise point is then determined by including an end stop which the print sheet hits with the remaining speed. Since this remaining speed is microscopically low, there is no danger that the front edge of the print sheet in feeding direction is damaged on impact with the stop surface or could bounce and/or spring back from this stop surface. This soft end positioning of the print sheet furthermore has the advantage that the print sheet can adapt completely to the contour of the stop surface, thus resulting in a maximized, precise alignment of the print sheet relative to the stop surface.

The following steps are relevant: The speed of the print sheet is slowed approximately 10 cm before reaching the end stop by using a print sheet brake, such that the sheet arrives only with a low kinematic rest energy at the end stop, wherein during the impact, the speed of the print sheet is <1 m/s. With such an end speed, no damage to the print sheet is possible, and the print sheet also does not experience a bouncing back because of an excessively high impact speed.

The course of the delay in the feeding speed for the print sheet can advantageously be determined according to an e-function or quasi (similar) e-function, wherein a truncating of the original course progression through another mathematical course is possible. Truncating is understood to mean in general the cutting off or separating from something, mostly in an imaginary sense. An example for this could be that the course of the e-function is not continued monotonously, but is continued with another mathematical function.

In both described cases, options 1 and 2, it applies that the dynamic of the force-triggering measures must take into consideration the manner in which the print sheet is transported. If transport belts are used for the print sheet transport, the control of all force-triggering measures must operatively be connected to the kinematic force exerted by the transport belts onto the print sheets. Thus, the braking effect of the means provided in principle should not collide with the kinematic force exerted by the transport belts, wherein for a specific constellation, it is not excluded that an at least partial superimposition of the two forces (braking force and transport force) is purposely desired.

Concerning the technical nature of the braking forces as well as their introduction and use relative to a precise positioning of the print sheet according to the invention in feeding direction, the following connections are obvious:

a) Intermittent, uniform or oscillating braking force triggering pulses can be applied, which apply the braking force directly, semi-directly or indirectly to the print sheet. These pulses can preferably be achieved with the necessary intensity and force by using a controlled supplying of air.
b) The braking-force triggering pulses can advantageously be generated with pneumatic air pulses or friction-triggering elements, wherein autonomously driven electronic or hydraulic elements can also be used. These last-mentioned elements can furthermore exert a direct or indirect braking force on the print sheets.
c) The pneumatic braking-force triggering pulses are preferably generated by at least one air stream that is directed toward the print sheet and blows onto a flexible element, arranged intermediary above the print sheet, wherein this element in the form of a lever yields as a direct result of the air stream or is movable via a bearing.
d) If the lever effect of the aforementioned element is converted directly, for example, it is advantageous if this element is composed of a fiber-reinforced textile-type belt, thus resulting in flexibility depending on its spring constant.
e) If the air pulse acts upon a lever arm when using a lever, the normal force and consequently the resulting braking force can be increased owing to the lever principle.
f) With the above-described measures, asymmetrically composed folded sheets can advantageously also be processed, starting with the premise that these folding sheets have the disadvantage of having different weight values on the left and on the right. According to the invention, the force of the air pulse and consequently also the resulting braking force can thus be adjusted with automatic pressure controllers. The necessary adjustment values for this are automatically calculated and converted by the control unit and/or the superimposed process control system.
g) The braking-force triggering pulses can simultaneously or at different points in time act upon a front and/or a rear edge of the print sheet in feeding direction with the same or different braking force variables, which makes it possible to simultaneously achieve a smoothing and/or stretching of the print sheet with this measure.

Accordingly, the system for braking and precisely positioning a print sheet in a processing machine is provided with mechanisms which exert along the feeding direction for the print sheet a pneumatic and/or mechanical braking force effect and/or a different frictional force acting upon the print sheet.

The precise positioning of the print sheet is connected to the operation of a downstream processing station and must thus be adapted such that the precise positioning is interdependent with the operational requirements of the downstream processing station.

In particular, the pneumatically operated braking-force triggering pulses as well as the vacuum-induced frictional forces can be used optimally if the goal is to generate intermittent, uniform or oscillating braking forces acting upon the print sheet.

A control unit is advantageously provided for this which makes available control profiles resulting from queried operating parameters, wherein it is also possible for stored control profiles to be called up if necessary.

The intermittent, uniform or oscillating braking-force triggering pulses exerted onto the print sheet, which cannot be generated by supplying air, are configured for a direct, semi-direct or indirect braking effect on the print sheet, meaning the braking forces can be achieved in connection with mechanically, electronically or hydraulically operated components.

In particular if the goal is to configure the braking and the positioning of print sheets deposited in an overlapping flow, the use of a vacuum that acts upon the lower surface of the print sheet in feeding direction has proven to be especially advantageous since the overlapping flow formed with the print sheets is not destroyed, so as to interfere, which is always a danger if only a perpendicular or quasi-perpendicular air supply is provided. A vacuum of this type can also be controlled easily, so that the introduced friction can finely adjust the print sheets in a stable position, wherein this method does not exclude the use of additional complementary braking forces.

A further option is thus provided for a targeted braking of the print sheet along the feeding direction, which consists of generating a vacuum on the underside of the print sheet, thereby causing the print sheet to be pressed against the support owing to suction effect that develops and thus ensure a further slowing down due to friction.

The active nozzle-injection of air onto the print sheet as well as the slowing down of said sheet as a result of the vacuum suction effect can be used either separately or in combination, wherein an intermittent control between these two is also possible.

Thus, if the braking forces depend on air, it is advantageous if each air-operated nozzle is controlled separately by a switching valve, taking into consideration the feeding speed and the composition of the print sheet.

A controlled interdependence between the individual switching valves increases the targeted effect of the air jets, so that it is possible to proactively remedy additional operational incongruences developing on the print sheet during the downstream processing operations.

The invention also relates to a method for a braking at a precise position of the print sheet within the meaning of a standstill at a precise point, as described in the above options 1 or 2, wherein the operational processes of downstream arranged processing stations are to be summarily included for a better understanding:

The air pressure needed for the braking is calculated based on the specified production data such as folding pattern, paper weight, paper width, cutting length, and the information is then sent to the automatic print controller. The print sheets can have different values for the left side and the right side, depending on the folding pattern.

The pressure reservoir that is located upstream of the pneumatic switching valve, as seen in flow direction, is filled by the pressure controller to the computed pressure level.

Insofar as the downstream processing station is a folding station, the print sheet arriving in/being supplied to the folding region is detected with the aid of a light barrier at the back edge. The light barrier simultaneously functions to synchronize the folding sword with the clock speed and thus compensates for all possible irregularities during the sheet transport.

Owing to the activated trigger signal, a signal for activating the pneumatic switching valve is triggered by taking into consideration dead time and speed compensation.

The air stored in the pressure reservoir is then released abruptly, whereupon the air nozzle releases a pulse-type blast of air.

The released air blast then can act either directly (not reinforced) onto the print sheet or indirectly (reinforced) onto a lever (in the present case a fiber-reinforced textile material) which transfers the force triggered by the air blast to the print sheet.

In the process, the print sheet is pressed against a table-type support and thus generates as a result of friction an inherent braking force that can be transferred to the print sheet.

A braking force can be exerted, if needed, either simultaneously or with a time delay onto the back edge of the print sheet. The bulk of the leading print sheet section (kinetic energy) thus causes a stretching of the material owing to the energy triggered by the braking effect, which results in a stiffening of the print sheet.

The braking force dynamic is selected such that the print sheet is safely stopped within the meaning of the two previously explained options 1 or 2, or if it rests against the sheet end stop, or if the folding sword takes over the print sheet. If a sheet end stop is activated, the point of insertion for the folding sword can occur with a slight delay.

A further option according to the invention makes it possible to achieve the precise positioning of the print sheet within the meaning of a standstill at a precise point even without the end stop, as a result of the described braking forces and their control.

Following the release of the air pulse, the pneumatic switching valve is closed immediately and the pressure controller fills up the air reservoir once more to the specified pressure, thus readying it for the following cycle.

However, the operation with an air reservoir is not absolutely required. The pulsed release of a specific amount of air, which depends on the clock speed, under a specified pressure can be achieved with a dynamically configured control which directly ensures the continuous availability of compressed air.

The method according to the invention for a precisely positioned stopping of the print sheet can thus also be supplemented by activating a vacuum acting upon the print sheet.

The essential advantages of the invention can be summarized point by point as follows:

1. As compared to traditional solutions, the invention is distinguished in that it uses practically no mechanically moving parts and no wear is thus generated, not even with high clock speeds.

2. The fast-switching valves needed for generating the short air pulses are tested components and are therefore operatively stable, in contrast to the braking brushes according to the prior art which must always be adjusted precisely to the paper thickness of the print sheets and are therefore subjected to constant wear.

3. It is furthermore advantageous that the means according to the invention for achieving a precisely positioned stopping, within the meaning of a standstill of the print sheet at a precise point, are not restricted by the space conditions in the region of the folding sword, which ensures easy access for correcting a problem in case of a backup.

4. The print sheets are not subjected to any damage during the described operations.

BRIEF DESCRIPTION OF THE DRAWINGS

In the following, the invention is explained in further detail with reference to the drawings, to which we expressly refer for all details not emphasized further in the description. All elements not absolutely necessary for the direct understanding of the invention have been omitted. The same elements in different figures are provided with the same reference numbers.

DETAILED DESCRIPTION

Figure 1:
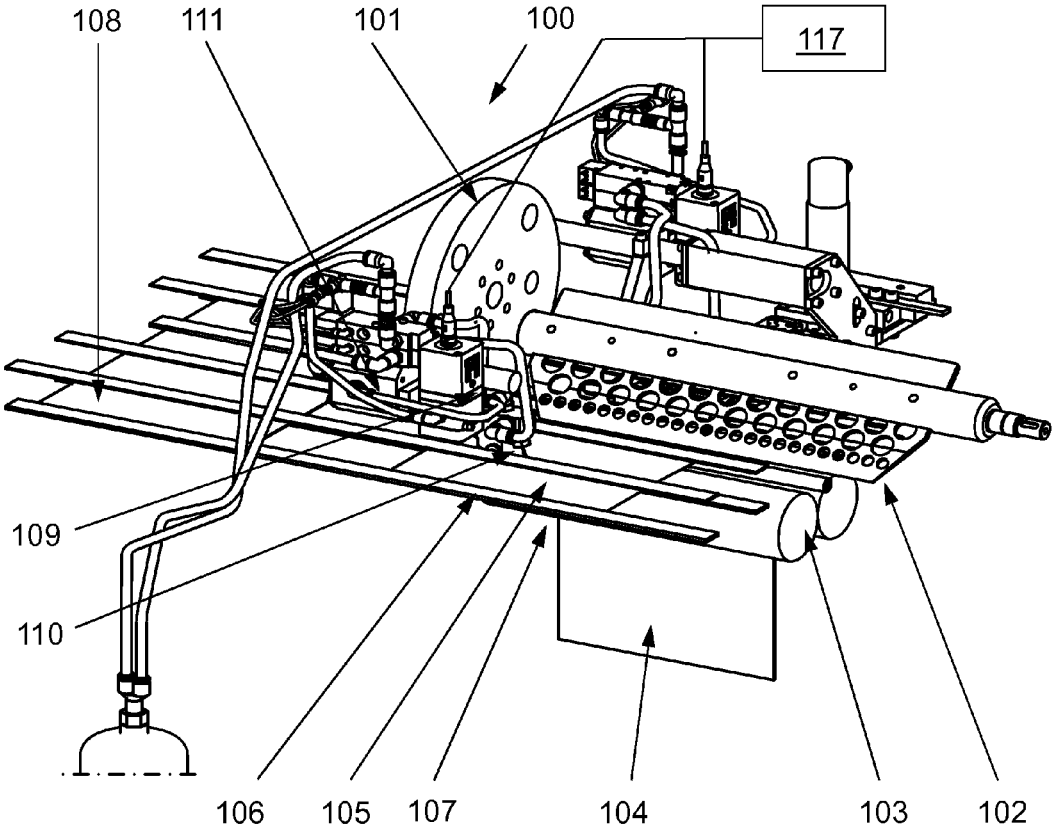
FIG. 1 is a perspective view of a complete overview of a longitudinal folding device, including a transport belt for supplying print sheets according to an embodiment of the invention.

FIG. 1 shows an area surrounding a longitudinal folding device 100, which essentially consists of a longitudinal folding device 101 which can be operated using a sword 102. FIG. 1 also shows the configuration of a folding roller pair 103. The operation of longitudinal folding device 101 is illustrated by a print sheet 104 that is folded in a longitudinal direction. Of course, the print sheets can also be folded inside a cross folding device, not shown further herein, wherein this device is operatively connected to the shown longitudinal folding device 101 or can be operated as an autonomous unit. The print sheet 105 is supplied via transport belts 106 and is stopped in the precise folding position 107, either with the aid of a first measure involving:

1) a precisely positioned stopping within the meaning of a standstill for the print sheet at a precise point, achieved solely through braking-force triggering pulses and/or by introducing additional braking forces, such as by generating a vacuum that acts upon the print sheet and/or the use of at least one mechanical element; or with aid of a second measure, involving:

2) a precisely positioned stopping within the meaning of a standstill of the print sheet at a precise point, owing to braking-force triggering pulses and/or the introduction of additional braking forces, as described in the above, which ensure that the feeding speed of the print sheet relative to the specified end position is slowed down enough so that it is near zero or tends toward zero. The final standstill at a precise point for the print sheet is then determined by taking into account an end stop that is not shown further in the figures and which the print sheet hits with the remaining speed.

Since this remaining speed is microscopically small, there is no danger that the front edge of the print sheet is damaged in the feeding direction once it hits the stop surface or could bounce back or spring back from this stop surface. This soft arrival in the end position for the print sheet additionally has the advantage that the print sheet can adapt completely to the stop surface, thus resulting in a maximized, precise alignment of the front edge of the print sheet with the stop surface.

The following steps are relevant with the latter measure:

The speed of the print sheet is slowed down approximately 10 cm prior to reaching the end stop, which is not shown herein but is familiar to one skilled in the art. The speed is slowed enough so that the sheet only hits the end stop with low kinematic residual energy, wherein the speed of the print sheet is <1 m/s during the impact. With an end speed of this type, no damage can occur to the print sheet and the print sheet also does not spring back as a result of an excessively high impact speed.

The course of the delay of the sheet feeding speed can advantageously be provided based on an e-function or quasi e-function (similar), wherein a truncating of the original course through other mathematical progressions is also possible. Truncating is understood to mean in general the cutting off or separating of something, mostly in a figurative sense. For an example, the course of the e-function may no longer be continued at one point and after which the breaking course is continued based on a different mathematical function.

However, for both described measures it is important that the dynamic of the braking-force triggering measures must take into consideration the manner in which the print sheets are transported. If transport belts are used for transporting the sheets, then a control unit 117 of all braking-force triggering measures must be considered in an operative connection with the kinematic force which is exerted by the transport belts onto the print sheets. The braking effect resulting from the specified means basically should not collide with the kinematic forces of the transport belts, wherein with specific constellations it is not impossible to purposely strive for an at least partial super-imposition of the two forces (braking force and transport force).

FIG. 1 furthermore shows a trailing print sheet 108, intended to show the operation with a clock speed of the longitudinal folding device 100.

The operation of the longitudinal folding device in an operative connection with a precise positioning of the print sheet 105 is configured as follows:

The air pressure needed for the braking is computed based on the specified production data such as folding pattern, paper weight, paper width and cut-off length. The information is then sent to an automatic controller, taking into consideration that depending on the folding pattern, the print sheet has different values on the left and the right side.

Furthermore, based on the specified production data such as folding pattern, paper weight, paper width and cut-off length, the air pressure required for decelerating the print sheet 105 is computed and the information is then sent to the automatic pressure controller 109, taking into consideration that depending on the folding pattern, the print sheet may have different values for the left and the right side.

The illustrated air nozzle 110 is used to blow an amount of air directly onto the print sheet. When computing the necessary amount of air, it is simultaneously taken into consideration that an additional amount of air may be necessary to neutralize the possibly occurring fluttering movements during the intake of the print sheet 105. Of course, it should also be considered that even after a complete stop of the print sheet 105, introducing additional amounts of air may be required for stabilizing the print sheet 105.

Thus, the pressure reservoir 111, arranged in a flow direction in front of a pneumatic switching valve, is filled to a required pressure with the aid of a pressure controller 109.

The print sheet 105 entering/fed into the folding region is detected at the back edge with the aid of a light barrier, not shown in further detail here, wherein this light barrier simultaneously functions to synchronize the clock speed of the folding sword 102, wherein the operation of the light barrier also detects irregularities within the belt transport of the print sheet 105 and compensates these via the control unit 117.

As a result of an activated trigger signal, a signal for activating the pneumatic switching valve is triggered, taking into consideration the dead time and speed compensation.

Following this, the air stored in the pressure reservoir 111 is released abruptly, whereupon the air nozzle 110 blows a pulse-type air jet onto the print sheet 105.

The released air blast can act directly upon the print sheet 105, or upon a lever (see FIG. 2, Position 112) which transmits the air blast and the corresponding resulting force to the print sheet. Of course, a configuration is also conceivable for which the air blast acts upon the print sheet 105 as well as the lever 112, wherein the directly and the indirectly introduced braking force can also be controlled intermittently and with differing pulse strengths of the air pulses (see FIG. 2, Position 114).

During the feeding operation and/or during the folding process, the print sheet 105 is pressed onto a table-type support owing to the pneumatically triggered forces, thus generating a braking force for the print sheet as a result of friction.

If necessary, an additional braking force can be directed simultaneously or phase-displaced onto the back edge of the print sheet 105, wherein a material stretching triggered by the braking effect results in reinforcing the print sheet 105.

The braking instant (see FIG. 3, Position 115) is selected such that the print sheet 105 is securely slowed to 0 and, in an imaginary sense, also when using a print sheet end stop, as described in the above. This specification can also be met if the slowing down of the print sheet 105 to 0 has reached the imaginary stopping point (FIG. 3, Position 113) where the folding sword 102 takes over the print sheet as intended. The takeover of the print sheet 105 by the folding sword 102 can thus be coordinated such that it coincides with the imaginary stopping point 113 for the print sheet end.

Figure 2:
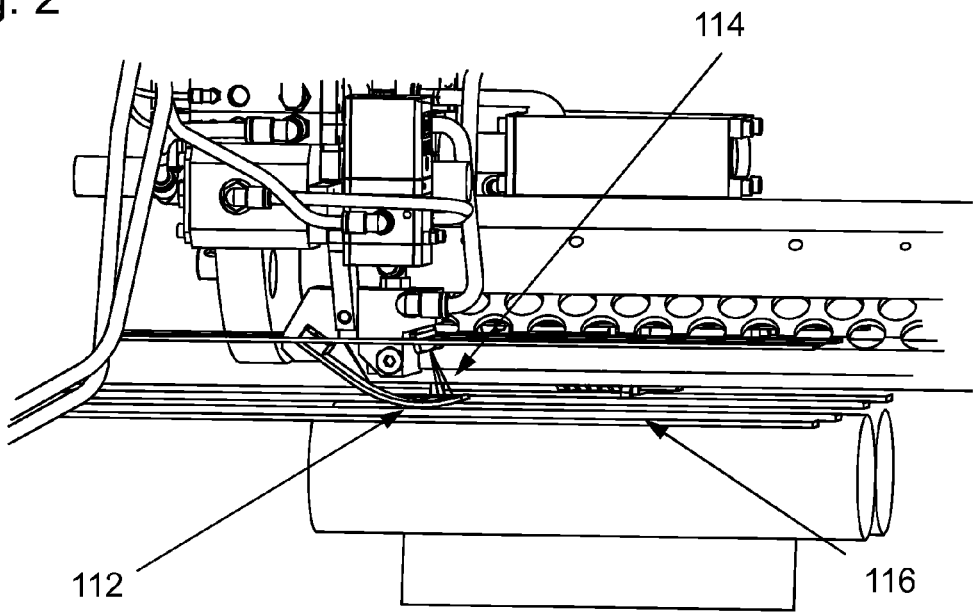
FIG. 2 is shows an enlarged area of FIG. 1 with a modification including an intermediary mechanical element used for braking and positioning of the print sheet in connection with applying an air pulse as braking force.

One option for a braking at a precise position of the print sheet 105, which is not shown further, can be achieved by activating an additional braking force based on friction. This can be achieved advantageously through generating a vacuum that acts upon the underside of the print sheet, wherein this option can without problem also be used together with the other previously explained braking forces. FIG. 2 furthermore shows the folding position 116 of the print sheet 105.

Figure 3:
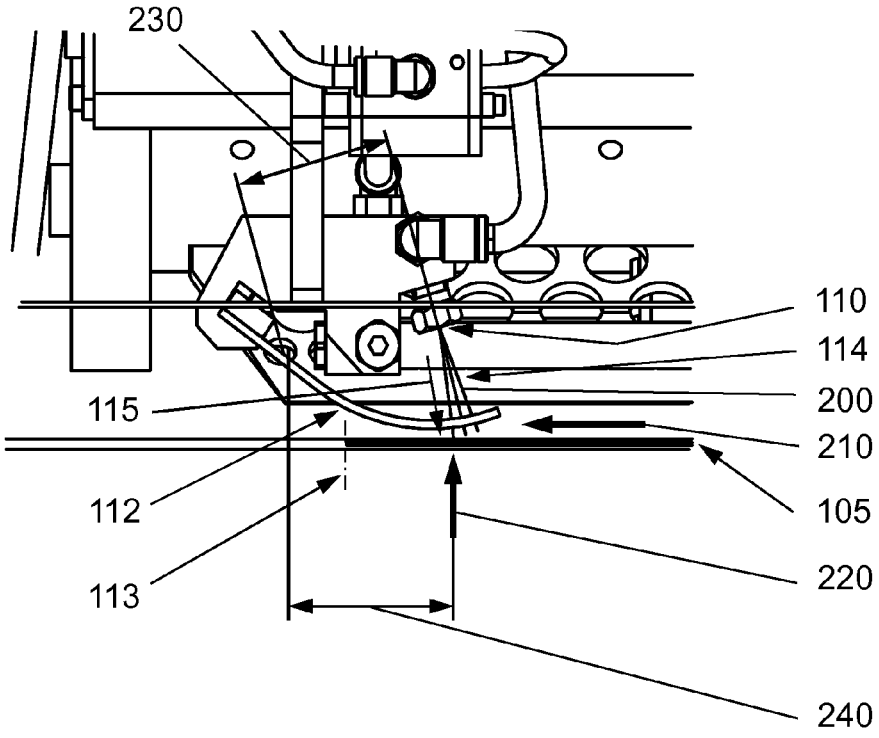
FIG. 3 is shows an enlarged area of FIG. 2 and further including geometric conditions and resulting forces during a braking operation.

FIG. 3 shows the geometric conditions and the resulting forces during the course of the braking operation for the print sheet. These values, namely the distances 230 and 240, as well as the forces $F_{pulse}$ (200), $F_{braking}$ (210) and $F_{normal}$ (220), which occur during the braking operation, are of a qualitative nature and are used as a basis for a controlled braking operation, wherein it is also possible to parameterize these values for control/regulation of the braking operation.

Following the release of the air pulses (FIG. 2, Position 114), the pneumatic switching valve is closed immediately and the pressure controller 109 again fills the compressed air reservoir 111 to the predetermined pressure, thus making it available for the next cycle.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for operating a device for braking and positioning a print sheet in a processing machine, wherein along the feeding direction for the print sheet at least one mechanism exerts a braking force onto the print sheet causing a positioning of the print sheet in connection with the operation of a downstream-arranged processing station, the method comprising:

generating, with at least one first mechanism, pneumatic, braking-force triggering pulses to act upon a top of the print sheet to press an underside of the sheet against a table-type support to generate, as a result of friction between the table-type support and the print sheet, a braking force that is transferred to the print sheet;

generating, with at least a second mechanism, a braking-force triggering frictional force to act upon the print sheet;

acting upon the print sheet with intermittent, uniform or oscillating braking forces generated with the first and second mechanisms; and controlling the braking forces generated by the first and second mechanisms by a control unit which is operated with changeable control profiles based on at least one of queried operating parameters and on stored control profiles.

2. The method according to claim 1, including generating the intermittent, uniform, or oscillating braking forces acting upon the print sheet by mechanisms that are effective directly, semi-directly or indirectly.

3. The method according to claim 1, wherein the braking forces are mechanically, electronically, hydraulically, pneumatically activated forces and the acting step includes focusing the activated forces directly or indirectly onto the print sheet.

4. The method according to claim 1, wherein the generating with a second mechanism includes generating a vacuum that acts upon the underside of the print sheet in a feeding direction in order to increase the friction.

5. The method according to claim 1, including supplementing at least one of the braking forces acting upon the print sheet during the feeding of the print sheet with an additional braking force that acts upon a back edge or a region of the back edge of the print sheet.

6. The method according to claim 1, including using at least one braking force in connection with forming an overlapping flow or separating the sheets from the overlapping flow of sheets transported in the feeding direction.

7. The method according to claim 1, wherein at least one braking force used for braking the print sheet subsequently functions as a cross-folding brake for the print sheet during operation in the downstream arranged processing station.

8. The method according to claim 1, including controlling at least one pneumatically operated braking force by at least one nozzle of a switching valve, taking into consideration a feeding speed and composition of the print sheet.

* * * * *